United States Patent [19]

Hatagishi et al.

[11] Patent Number: 5,000,693

[45] Date of Patent: Mar. 19, 1991

[54] ELECTRIC JUNCTION BOX

[75] Inventors: Yuji Hatagishi, Haibara; Naoki Manabe, Kosai, both of Japan

[73] Assignee: Yazaki Corporation, Tokyo, Japan

[21] Appl. No.: 510,764

[22] Filed: Apr. 18, 1990

[30] Foreign Application Priority Data

Apr. 26, 1989 [JP] Japan ..... 1-104578

[51] Int. Cl.[5] ..... H01R 13/629

[52] U.S. Cl. ..... 439/248; 439/34

[58] Field of Search ..... 439/34, 246–248, 439/534, 359, 362

[56] References Cited

U.S. PATENT DOCUMENTS

| | | | |
|---|---|---|---|
| 4,780,090 | 10/1988 | Sugiyama et al. | 439/247 |
| 4,815,984 | 3/1989 | Sugiyama et al. | 439/211 |
| 4,915,641 | 4/1990 | Misilin et al. | 439/247 |
| 4,954,085 | 9/1990 | Inoue et al. | 439/34 |
| 4,954,102 | 9/1990 | Ozaki et al. | 439/34 X |
| 4,956,748 | 11/1990 | Yamamoto et al. | 439/34 X |

*Primary Examiner*—Eugene F. Desmond

*Attorney, Agent, or Firm*—Armstrong, Nikaido, Marmelstein, Kubovcik & Murray

[57] ABSTRACT

The electric junction box according to this invention consists of an insulating box with a connector receiving portion and an opening formed next to it in which a through-connector is mounted. A multipole connector consisting of two portions formed as one portion is engaged with the connector receiving portion of the junction box and with the through-connector to provide electrical connection. A locking means is provided at the opening between the through-connector and the insulating box to prevent the through-connector from slipping off. The locking means is so constructed as to allow the slight movement in the opening of the through-connector. This permits the through-connector to be shifted and aligned with the incoming mating connector of the multipole connector as the mating connector is fastened to the through-connector, thus assuring correct and smooth connection between them.

4 Claims, 5 Drawing Sheets

ELECTRIC JUNCTION BOX

BACKGROUND OF THE INVENTION

The present invention relates to an electric junction box used for interconnecting wiring harnesses

PRIOR ART

In connecting wiring harnesses to an electric junction box while at the same time interconnecting the wiring harnesses with each other, a means as shown in FIGS. 5 and 6 are commonly used. The process of connecting the wiring harness Wa to the junction box B and also interconnecting other wiring harnesses consists in the following steps. First, a connector 34 at the end of the wiring harness Wb is attached to the connector receiving portion 31 of an insulating box 30. The connectors 39, 40 at the ends of the wiring harnesses Wa, Wc are formed integral as one piece through a connecting portion 41 so that they can be used as a multipole connector 38 of bolt fastening type. The connector 34 is provided with a bolt receiver 35 which has a built-in nut 35*a* (FIG. 8), while the multipole connector 38 is provided with a bolt 42.

The connector 34 is mounted in a way as shown in FIG. 7. The insulating box 30 is attached with a metallic locking piece 32, which has a back-slip preventing projection 33. A receptor frame 36 is provided at the side of the connector 34, and the locking piece 32 is inserted into the receptor frame 36 to engage the back-slip preventing projections 33, 37, thus locking the two connectors together.

The above construction allows connection between the wiring harness Wa and the electric junction box 8 and between the wiring harnesses Wb and Wc in one connecting procedure, by engaging the portions 39, 40 of the multipole connector 38 with the connector receiving portion 31 and the connector 34 respectively and then fastening the bolt 42.

The wiring harnesses Wb and Wc are not directly connected to the internal circuit of the junction box B, so the connectors 34 and 40 are each called a through-connector.

PROBLEMS TO BE SOLVED BY THE INVENTION

Such a multipole connector 38 as described above has its two portions—the junction box connector portion 39 to be connected to the junction box and the through-connector portion 40—integrally formed. On the junction box side, however, the connector receiving portion 31 and the through-connector 34 are separately formed. Therefore, as shown in FIG. 8, it is very difficult to match the pitches of the male terminals 44, 43' installed in the connector receiving portion 31 and the through-connector 34 with those of the female terminals (not shown) installed in the junction box connector portion 39 and through-connector portion 40 of the multipole connector 38.

As a result, it may not be possible to smoothly engage the multipole connector 38 nor fasten the bolt. In some cases either the female or male terminals may be deformed making the connection impossible. The multipole connector of the bolt fastening type therefore cannot be fully taken advantage of.

This invention has been accomplished to eliminate the above-mentioned drawbacks.

SUMMARY OF THE INVENTION

To achieve the above objective, the electric junction box according to this invention comprises: an insulating box having a connector receiving portion and a junction box portion, said insulating box having opening passing therethrough next to the connector receiving portion; a bolt-fastening type multipole connector consisting of a junction box connector portion to be engaged with the connector receiving portion of said insulating box and a through-connector portion to be engaged with the through-connector mounted in the insulating box, said junction box connector portion and said through-connector portion of the multipole connector being formed integral as one piece; a through-connector adapted to be inserted and mounted in said opening of the insulating box from a predetermined direction for mating with said through-connector portion of the bolt-fastening type multipole connector; and locking means provided at said opening between the insulating box and the through-connector to lock the through-connector with said opening but allow the through-connector to move in the opening of said insulating box in directions perpendicular to said predetermined direction; whereby as the multipole connector is engaged with the mating through-connector through the insulating box and fastened by the bolt, the through-connector in the insulating box is automatically shifted to a proper position and correctly aligned with the multipole connector.

With the electric junction box of this invention, the through-connector mounted adjacent to the connector receiving portion of the insulating box is allowed to shift back and forth and right and left, so that the center of the multipole connector—which consists of the junction box connector portion to be engaged with the connector receiving portion of the junction box and the through-connector portion to be engaged with the mating through-connector attached to the junction box—can be perfectly aligned with the centers of the mating connectors. This in turn eliminates the possibility of the female and male terminals abutting against and bending or damaging each other due to misalignment of centers of the mating connectors, ensuring correct and smooth engagement and connection of the multipole connector.

DESCRIPTION OF THE PREFERRED EMBODIMENT

Now, the present invention will be described by referring to the accompanying drawings that illustrate one embodiment.

Figure 1:
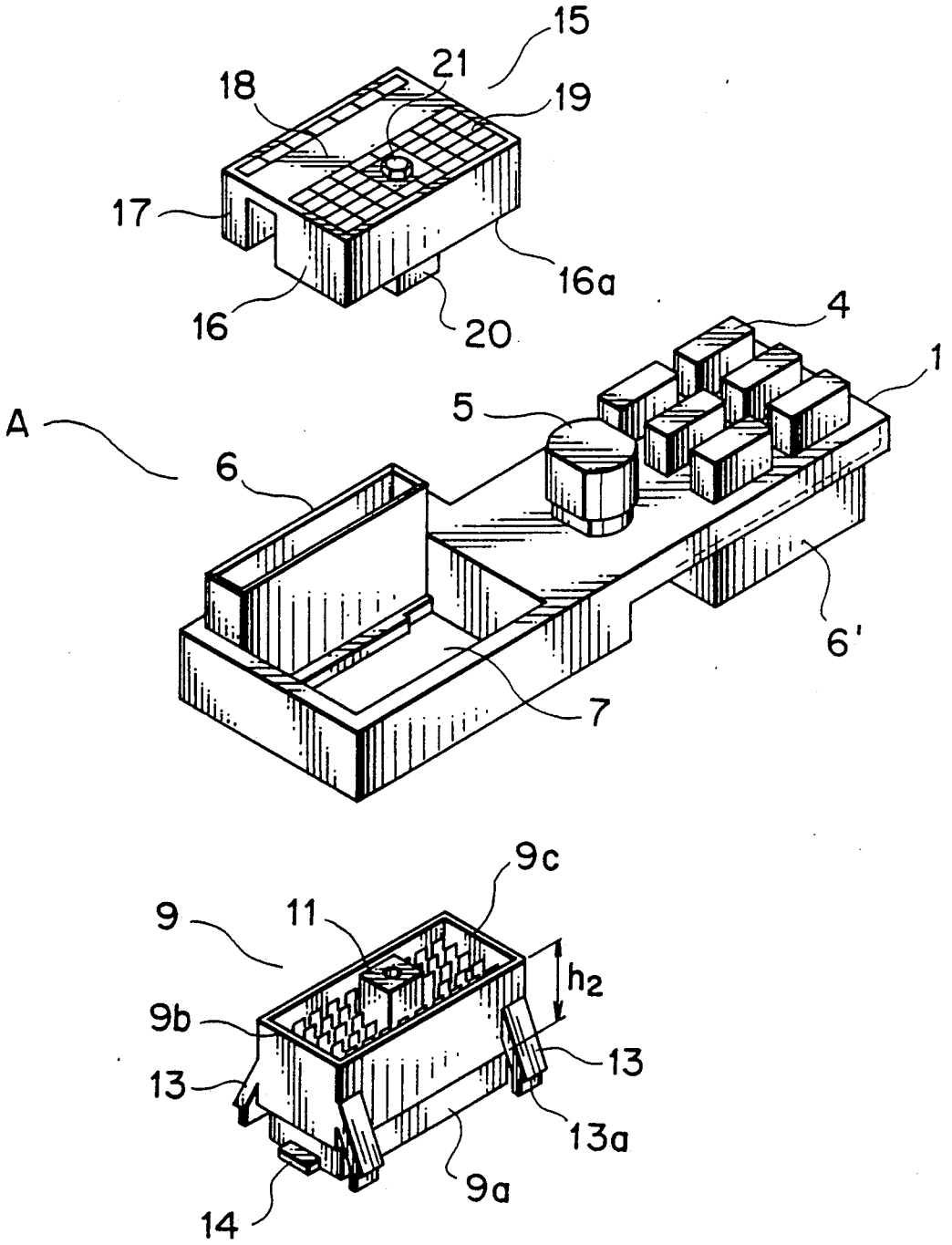
FIG. 1 is an exploded perspective view of one embodiment of an electric junction box according to this invention.
Figure 2:
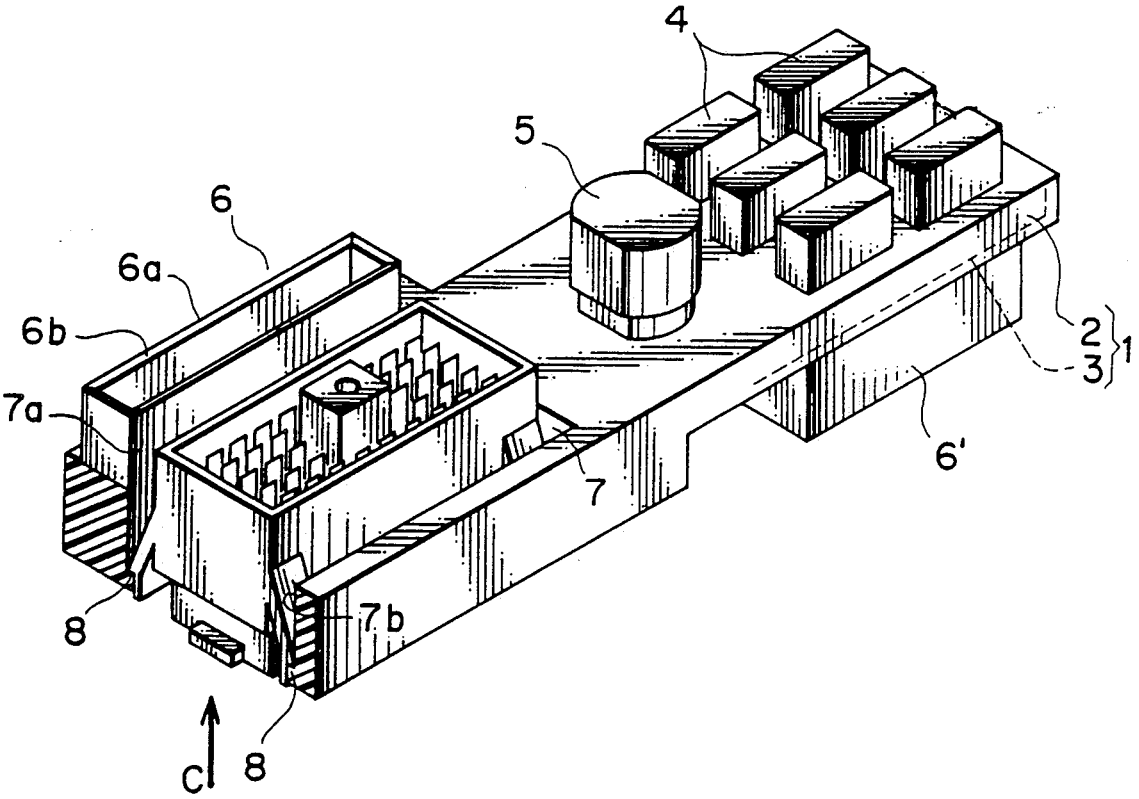
FIG. 2 is a perspective view of the essential portion of the assembled junction box of FIG. 1.
Figure 3:
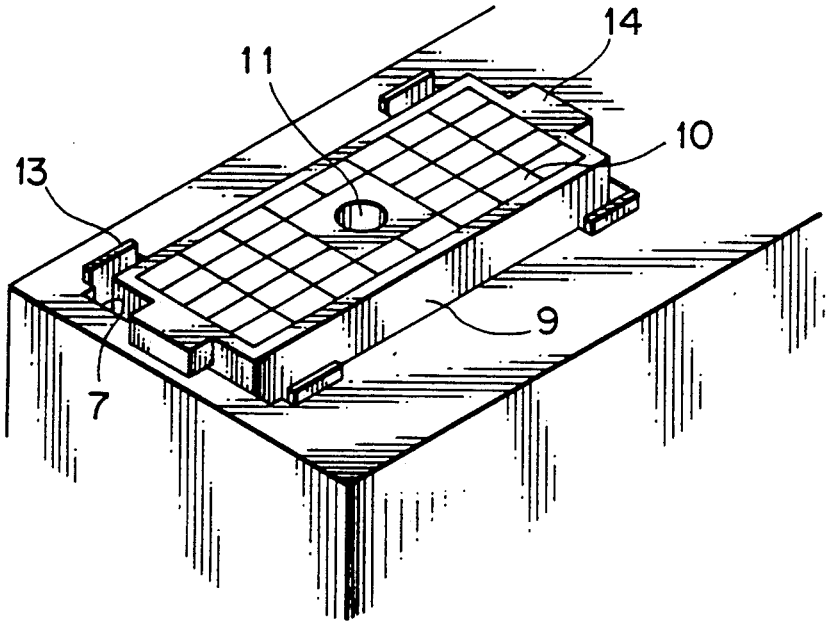
FIG. 3 is a bottom view as seen from an arrow C in FIG. 2.

In FIGS. 1 to 3, reference numeral 1 represents an insulating box of electric junction box A, which consists of an upper cover 2 and a lower cover 3. The insulating box 1 contains bus bars and a printed circuit card (not shown). Mounted on the upper cover 2 are a large number of electric parts such as fuses 4 and relay 5.

The insulating box 1 is formed with a connector receiving portion 6 and also with a through-connector mounting portion 7 adjacent to the connector receiving portion 6, the through-connector mounting portion 7 vertically passing through the insulating box 1. Opposing inner walls 7*a*, 7*b* of the through-connector mounting portion 7 are formed with locking claws 8 at the lower part thereof on both sides.

A through-connector 9 is formed as a female through-connector consisting of a housing 9*a* and a hood 9*b* on the upper side of the housing 9*a*, the housing having a large number of terminal accommodating cavities 10. At the center of the hood 9*b* there is formed a bolt receptor 11 that has a built-in nut 12 (see FIG. 4). The bolt receptor 11 preferably projects slightly above an upper edge 9*c* of the hood 9*b*.

Longitudinally extending side walls of the housing 9*a* of the through-connector 9 have downwardly projecting flexible lock arms 13 on both sides. The end walls of the connector 9 are each formed with a stopper 14 at the lower end portion for preventing the through-connector 9*a* from slipping out from the other side of the insulating box. The flexible lock arms 13 have engagement steps 13*a* formed at their free ends that engage with the locking claws 8.

A multipole connector 15 of bolt fastening type consists, as with the conventional multipole connectors, of a through-connector portion 16 and a junction box connector portion 17 to be coupled to the junction box, the two portions being formed integral with each other through a connecting portion 18. The through-connector portion 16 is provided with a downwardly projecting bolt retainer cylinder 20 that sleeves over the bolt receptor 11, the bolt retainer cylinder 20 having a bolt 21 fitted therein.

Terminal accommodating cavities 19 of the multipole connector 15 each have female terminals (not shown) installed therein. On the junction box A side, the terminal accommodating cavities 10 of the connector receiving portion 6 and of the through-connector 9 have tab-like male terminals 22, 22′ (see FIG. 4) fitted therein. The male terminals 22 are connected to and erected from the bus bars in the internal circuit of the junction box.

Figure 4A:
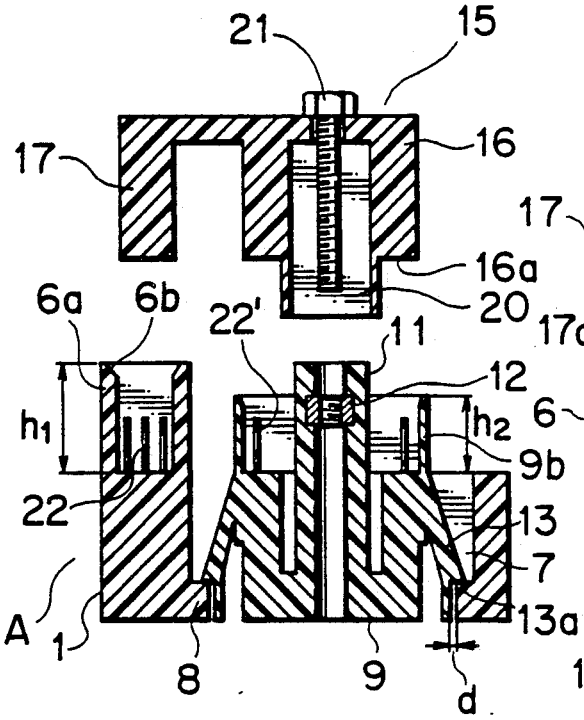
FIGS. 4A to 4D are explanatory views showing the process of engaging the mating connectors.

As shown in FIG. 4A, the hood 6*a* of the connector receiving portion 6 and the hood 9*b* of the through-connector 9 have the heights $h_1$ and $h_2$ such that $h_1 > h_2$. The upper edge of the hood 6*a* is preferably chamfered off at 6*b* as an insertion guide.

Next, referring to FIGS. 4A to 4D, we will explain about the process of locking the through-connector 9 and engaging and fixing the multipole connector 15.

When, as shown in FIG. 4A, the through-connector 9 is inserted into the mounting portion 7 of the insulating box 1 from below, the stopper 14 abuts against the underside of the box (see FIG. 3) and the engagement step portions 13*a* of the flexible lock arms 13 engage with the locking claws 8, locking the connector 9.

Figure 4B:
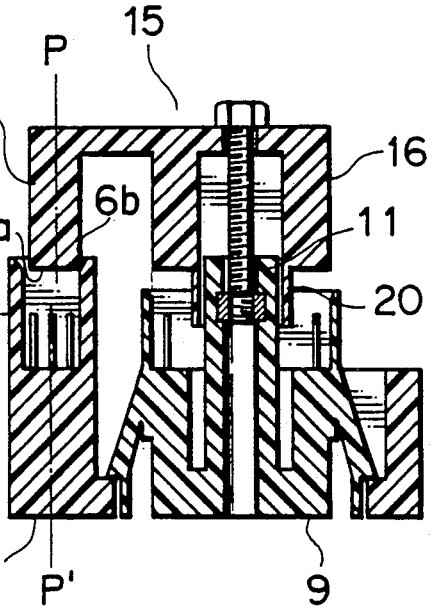

Then, as shown in FIG. 4B, the bolt retainer cylinder 20 of the multipole connector 15 is fitted over the bolt receptor 11 of the through-connector 9 and the centers of the through-connector portion portion 16 of the multipole connector 15 and the mating through-connector 9 in the insulating box are aligned before the multipole connector 15 is fastened.

At this time, should the center P of the junction box connector portion 17 be misaligned even slightly from the center P′ of the connector receiving portion 6 as shown, the engagement surface 17*a* of the junction box connector portion 17 comes into contact with the chamfered surface 6*b*.

Figure 4C:
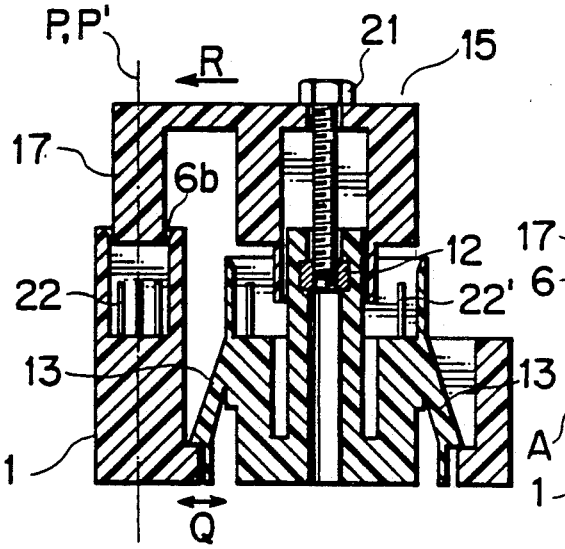
Figure 4D:
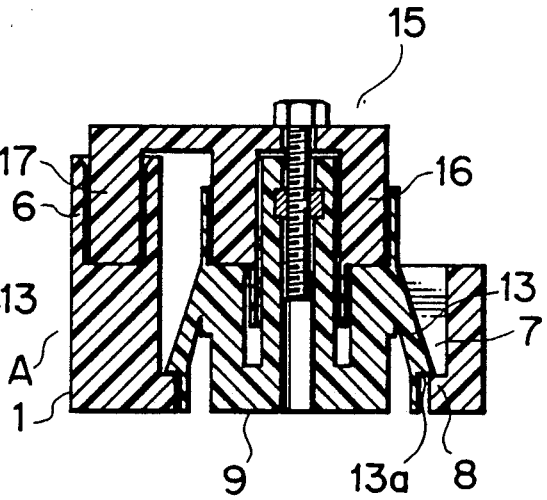
Figure 5:
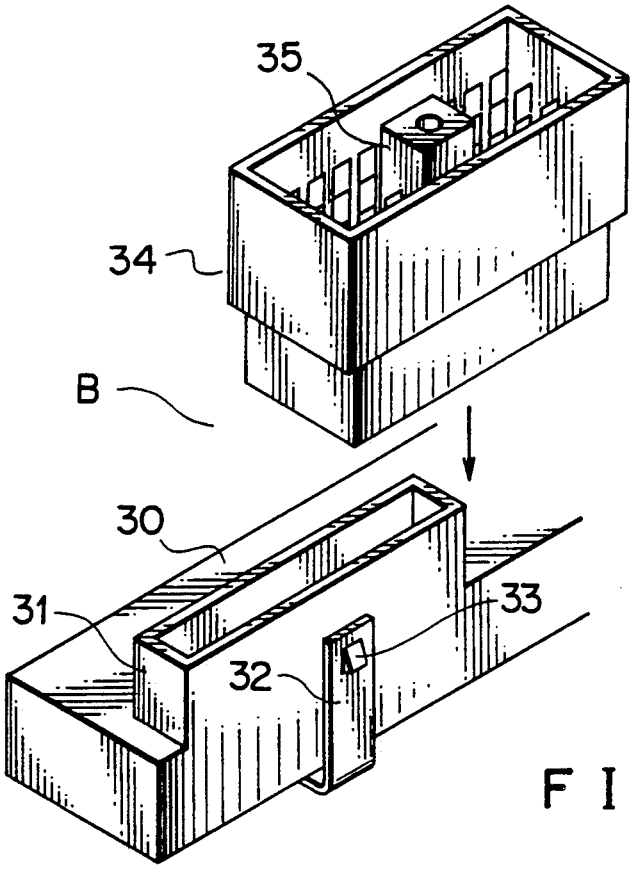
FIG. 5 is a perspective view of the essential part of the conventional electric junction box disassembled.
Figure 7:
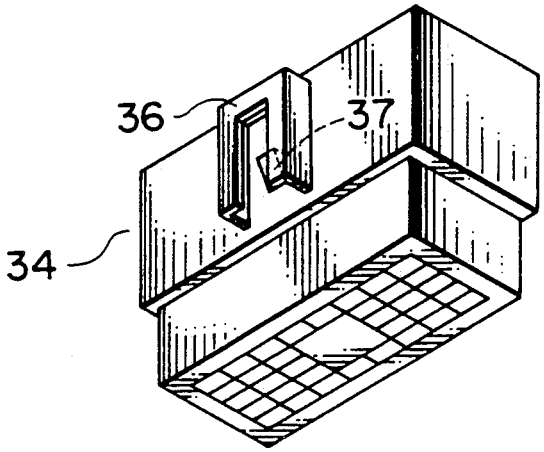
FIG. 7 is an explanatory view showing the structure for mounting the connector 34 of FIG. 6.
Figure 8:
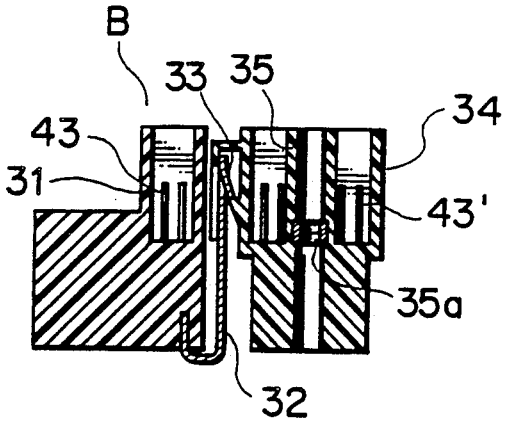
FIG. 8 is an explanatory view showing the mounting structure of FIG. 7 engaged.
Figure 8:
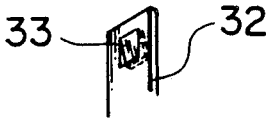
Figure 6:
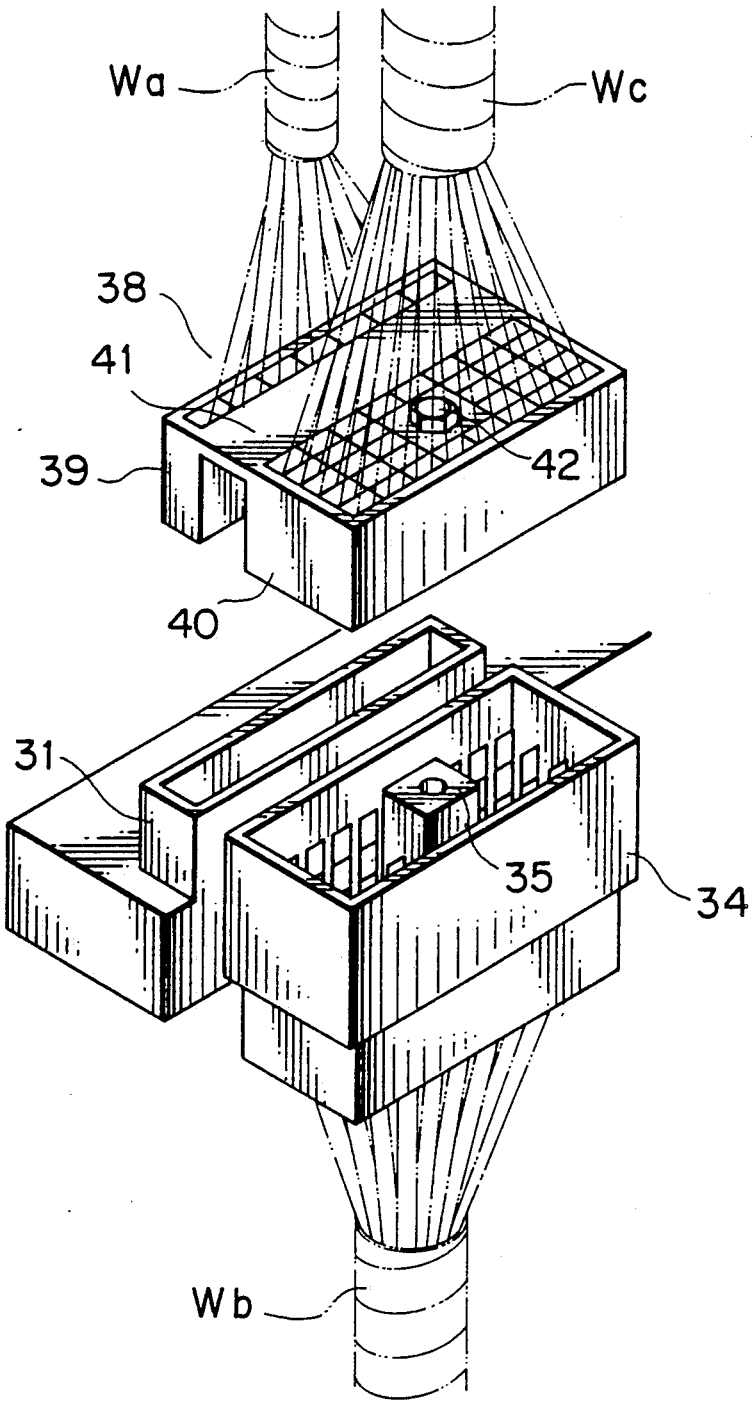
FIG. 6 is a perspective view of the assembled junction box of FIG. 5.

Then, as shown in FIG. 4C, as the bolt 21 is screwed into the nut 12, the flexible lock arms 13 on each side are resiliently deflected in the direction of arrow Q, so that the junction box connector portion 17 engaged with the junction box is guided along the chamfered surface 6*b*, moving the entire multipole connector 15 in the direction of arrow R. This in turn causes the centers P, P′ to completely match each other with the result that the pitch of the male terminals 22 and 22′ coincide with those of the mating female terminals. Therefore, as shown in FIG. 4D, the portions 16, 17 of the multipole connector 15 are correctly aligned with the mating connectors 9, 6 while being fastened together.

If a clearance d is provided between the locking claws 8 and the engagement steps 13*a* of the flexible lock arms 13 as shown in FIG. 4A, the movement of the through-connector 9 can be more smoothly performed in a longitudinal direction (perpendicular to the arrow R).

Although in the foregoing we have described an example where the flexible lock arms 13 are provided to the through-connector 9, they may be provided to the inner walls 7*a*, 7*b* of the mounting portion 7.

The advantage of this invention may be summarized as follows. Since the connector to mate with the junction box and the through-connector of the bolt-fastening type multipole connector can be correctly aligned with the connector receiving portion of the junction box and with the mating through-connector, respectively, during the process of engagement and connection, there is no risk of the female and male terminals being poorly connected or damaged, making the connection work simple and easy. The electric junction boxes thus formed provides highly reliable electrical connection.

What is claimed is:

1. An electric junction box comprising:

an insulating box having a connector receiving portion and a junction box portion, said insulating box having an opening passing therethrough adjacent said connector receiving portion;

a bolt-fastening type multiple connector consisting of a junction box connector portion to be engaged with the connector receiving portion of said insulating box and a through-connector portion to be engaged wtih said opening, said junction box connector portion and said through-connector portion of the multipole connector being formed integral as one piece;

a through-connector adapted to be inserted and mounted in said opening of said insulating box from a predetermined direction for mating with said through-connector portion of the bolt-fastening type multipole connector;

a locking means provided at said opening between the insulating box and the through-connector to lock the through-connector within said opening but allow the through-connector to move within the opening of said insulating box in directions perpendicular to said predetermined direction;

whereby as the multiple connector is engaged with the mating through-connector through the insulating box and fastened by a bolt, the through-connector in the insulating box is automatically shifted to a proper position and correctly aligned with the multipole connector.

2. An electric junction box as set forth in claim 1, wherein said locking means consists of resilient lock arms that project downwardly from parallel side walls of the through-connector on both sides and which also have engagement steps at ends thereof, and locking claws provided to inner walls of the opening in the insulating box, said locking claws being adapted to engage with the engagement steps of the lock arms.

3. An electric junction box as set forth in claim 1, wherein a stopper is projected from parallel end walls of the through-connector installed in the insulating box so that it will engage with the insulating box.

4. An electric junction box as set forth in claim 2, wherein a stopper is projected from parallel end walls of the through-connector installed in the insulating box so that it will engage with the insulating box.

* * * * *